US011346345B2

(12) United States Patent
Han et al.

(10) Patent No.: US 11,346,345 B2
(45) Date of Patent: May 31, 2022

(54) ELECTRIC COMPRESSOR SYSTEM FOR VEHICLE

(71) Applicants: HYUNDAI MOTOR COMPANY, Seoul (KR); KIA MOTORS CORPORATION, Seoul (KR)

(72) Inventors: Jong Wan Han, Suwon-si (KR); Sung Min Ahn, Suwon-si (KR); Seong Jae Ahn, Bucheon-si (KR)

(73) Assignees: HYUNDAI MOTOR COMPANY, Seoul (KR); KIA MOTORS CORPORATION, Seoul (KR)

( * ) Notice: Subject to any disclaimer, the term of this patent is extended or adjusted under 35 U.S.C. 154(b) by 211 days.

(21) Appl. No.: 16/822,179

(22) Filed: Mar. 18, 2020

(65) Prior Publication Data

US 2021/0123450 A1 Apr. 29, 2021

(30) Foreign Application Priority Data

Oct. 28, 2019 (KR) ..... 10-2019-0134814

(51) Int. Cl.

| | |
|---|---|
| ***F04C 23/00*** | (2006.01) |
| ***F04C 28/04*** | (2006.01) |
| ***F04C 18/02*** | (2006.01) |
| ***F04C 11/00*** | (2006.01) |
| ***F04C 18/44*** | (2006.01) |

(Continued)

(52) U.S. Cl.

CPC ..... *F04C 23/001* (2013.01); *F04C 11/00* (2013.01); *F04C 11/001* (2013.01); *F04C 18/0215* (2013.01); *F04C 18/22* (2013.01); *F04C 18/44* (2013.01); *F04C 23/00* (2013.01); *F04C 23/008* (2013.01); *F04C 28/02* (2013.01); *F04C 28/04* (2013.01); *F04C 11/005* (2013.01); *F04D 13/14* (2013.01); *F04D 25/06* (2013.01); *F04D 25/16* (2013.01); *F04D 29/043* (2013.01)

(58) Field of Classification Search

CPC .... F04C 23/001; F04C 11/001; F04C 23/008; F04C 18/0215; F04C 18/22; F04C 18/44; F04C 11/005; F04C 28/04; F04C 11/00; F04C 23/00; F04C 28/02; F04D 13/14; F04D 25/16; F04D 25/06

See application file for complete search history.

(56) References Cited

U.S. PATENT DOCUMENTS 6,484,504 B1 * 11/2002 Aquino ..... F01C 1/22 60/726
6,749,405 B2 * 6/2004 Bassine ..... C01B 13/0248 417/313

* cited by examiner

*Primary Examiner* — Peter J Bertheaud
(74) *Attorney, Agent, or Firm* — Morgan, Lewis & Bockius LLP

(57) ABSTRACT

An electric compressor system for a vehicle includes: an electric motor having a rotor and a motor shaft which selectively rotate in a first rotation direction or a second rotation direction; an external rotation shaft extending from the motor shaft of the electric motor; a first compressor unit connected to the external rotation shaft and selectively compressing a first fluid according to the rotation direction of the external rotation shaft; and a second compressor unit connected to the external rotation shaft and selectively compressing a second fluid according to the rotation direction of the external rotation shaft, wherein the first compressor unit and the second compressor unit are sequentially arranged on the external rotation shaft, the first compressor unit is fluidly connected to a first fluid system, and the second compressor unit is fluidly connected to a second fluid system.

9 Claims, 5 Drawing Sheets

(51) Int. Cl.

| | |
|---|---|
| ***F04C 18/22*** | (2006.01) |
| ***F04C 28/02*** | (2006.01) |
| *F04D 25/06* | (2006.01) |
| *F04D 25/16* | (2006.01) |
| *F04D 29/043* | (2006.01) |
| *F04D 13/14* | (2006.01) |

ELECTRIC COMPRESSOR SYSTEM FOR VEHICLE

CROSS-REFERENCE TO RELATED APPLICATION

The present application is based on and claims the benefit of priority to Korean Patent Application No. 10-2019-0134814 filed on Oct. 28, 2019 in the Korean Intellectual Property Office, the disclosure of which is incorporated herein in its entirety by reference.

TECHNICAL FIELD

The present disclosure relates to an electric compressor system for a vehicle, and more particularly, to a vehicle electric compressor system capable of selectively operating two or more compressor units individually connected to two or more fluid systems by a single electric motor.

BACKGROUND

A suspension system mounted in a vehicle absorbs the shock transmitted from a road surface to improve ride quality, or controls the irregular motion of wheels when the vehicle is driving on a rough road surface to increase the grip of tires on the road and reliably ensure that driving and braking forces are delivered to the road surface.

Meanwhile, air suspension utilizing an air spring is replacing conventional suspension, and the air suspension is designed to improve ride quality. The air suspension includes the air spring, and an air supply system for supplying air to the air spring. The air supply system includes an air compressor compressing the air, an air tank storing the compressed air, and one or more solenoid valves.

Lately, height adjustable suspension has been used a lot in vehicles. The height adjustable suspension may allow a controller to vary a pressure in the air spring according to driving conditions (e.g., load condition, speed condition, etc.) of the vehicle and adjust a ride height. For example, when the vehicle is driving off-road, a vehicle body is raised by the height adjustable suspension, which prevents damage to an engine, a transmission, etc.

In addition, vehicles are equipped with an air conditioning system that heats and cools the air in a passenger compartment for passengers' comfort. The air conditioning system for vehicles includes an evaporator, a compressor, a condenser, and an expansion valve. The compressor of the air conditioning system is connected to a crankshaft of an internal combustion engine through a pulley, a belt, and the like.

As the height adjustable suspension and the air conditioning system are mounted independently on a chassis of the vehicle, they may take up a relatively large mounting space in the vehicle body, making it difficult to expand the passenger compartment of the vehicle. In particular, vehicles, such as electric vehicles and high occupancy vehicles, essentially require the height adjustable suspension, which increases the cost and weight. However, the height adjustable suspension provides no function other than the height adjustment function, which makes the height adjustable suspension less useful than the mounting space occupied in the vehicle body.

The vehicle includes a plurality of fluid systems utilizing compressed fluids, such as the height adjustable suspension and the air conditioning system. The plurality of fluid systems are individually provided with compressors for compressing the corresponding fluids, which relatively narrow the mounting space in the vehicle body and increase the cost and weight.

The above information described in this background section is provided to assist in understanding the background of the inventive concept, and may include any technical concept which is not considered as the prior art that is already known to those skilled in the art.

SUMMARY

The present disclosure has been made to solve the above-mentioned problems occurring in the prior art while advantages achieved by the prior art are maintained intact.

An aspect of the present disclosure provides an electric compressor system for a vehicle, capable of selectively operating two or more compressor units individually connected to two or more fluid systems by a single electric motor.

According to an aspect of the present disclosure, an electric compressor system for a vehicle may include: an electric motor having a rotor and a motor shaft which selectively rotate in a first rotation direction or a second rotation direction; an external rotation shaft extending from the motor shaft of the electric motor; a first compressor unit connected to the external rotation shaft and configured to selectively compress a first fluid according to the rotation direction of the external rotation shaft; and a second compressor unit connected to the external rotation shaft and configured to selectively compress a second fluid according to the rotation direction of the external rotation shaft, wherein the first compressor unit and the second compressor unit may be sequentially arranged on the external rotation shaft, the first compressor unit may be fluidly connected to a first fluid system, and the second compressor unit may be fluidly connected to a second fluid system.

The electric motor may be driven by a motor control circuit, and the motor control circuit may change a polarity of a voltage applied to the electric motor.

The external rotation shaft may rotate in the first rotation direction when the motor control circuit applies a positive voltage to a first electrode of the electric motor.

The external rotation shaft may rotate in the second rotation direction when the motor control circuit applies a positive voltage to a second electrode of the electric motor.

The first compressor unit may include a first housing having a first compression cavity, and a first compression element compressing the first fluid received in the first compression cavity. The first compression element may be selectively connected to or disconnected from the external rotation shaft through a first one-way clutch.

The first one-way clutch may be interposed between the external rotation shaft and the first compression element. The first one-way clutch may allow the external rotation shaft and the first compression element to be connected when the external rotation shaft rotates in the first rotation direction.

The second compressor unit may include a second housing having a second compression cavity, and a second compression element compressing the second fluid received in the second compression cavity. The second compression element may be selectively connected to or disconnected from the external rotation shaft through a second one-way clutch.

The second one-way clutch may be interposed between the external rotation shaft and the second compression element. The second one-way clutch may allow the external rotation shaft and the second compression element to be connected when the external rotation shaft rotates in the second rotation direction.

The first fluid system may be a height adjustable suspension system.

The second fluid system may be an air conditioning system.

BRIEF DESCRIPTION OF THE DRAWINGS

The above and other objects, features and advantages of the present disclosure will be more apparent from the following detailed description taken in conjunction with the accompanying drawings.

DETAILED DESCRIPTION

Figure 1:
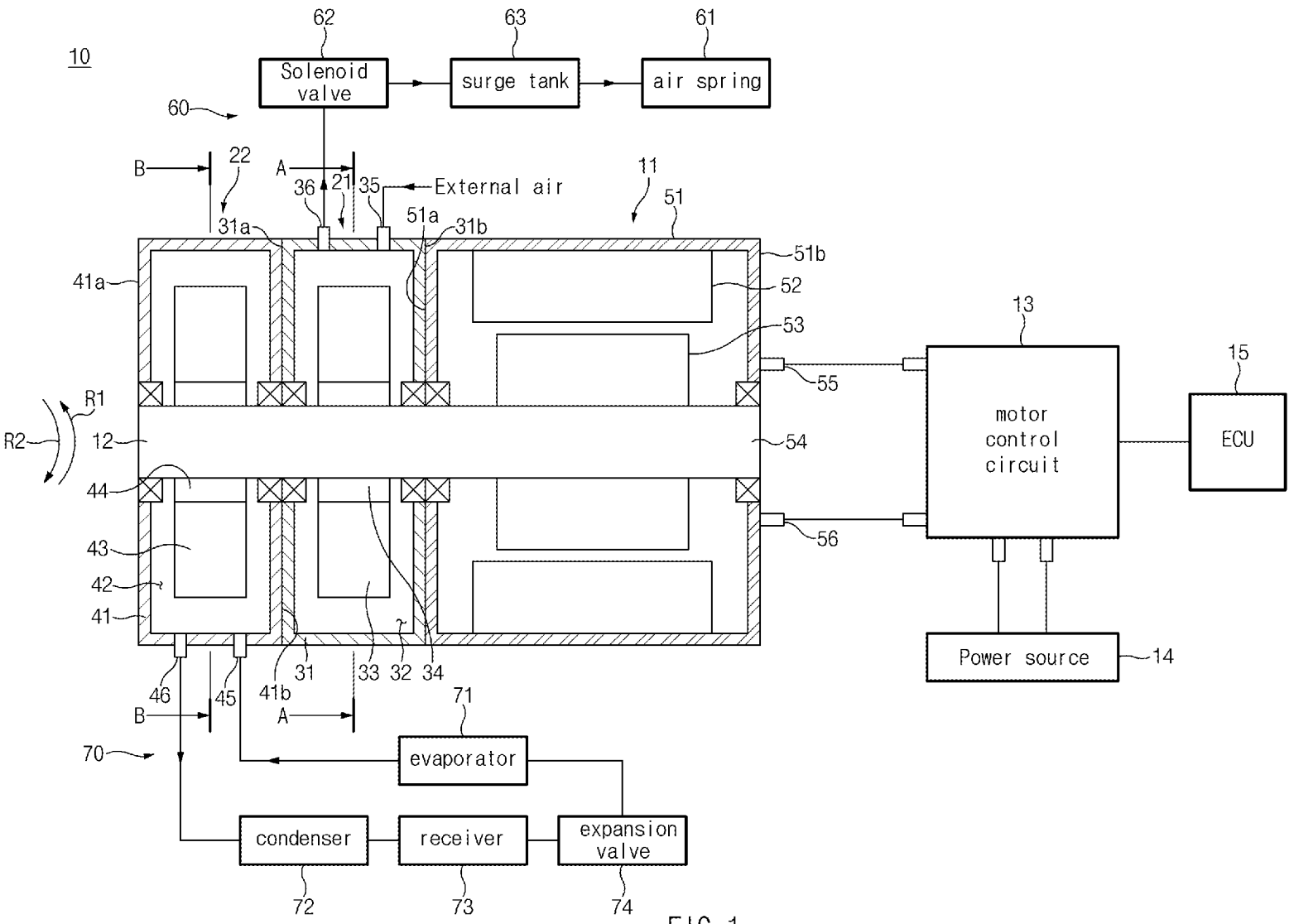
FIG. 1 illustrates an electric compressor system for a vehicle according to an exemplary embodiment of the present disclosure.

Hereinafter, exemplary embodiments of the present disclosure will be described in detail with reference to the accompanying drawings. In the drawings, the same reference numerals will be used throughout to designate the same or equivalent elements. In addition, a detailed description of well-known techniques associated with the present disclosure will be ruled out in order not to unnecessarily obscure the gist of the present disclosure.

Terms such as first, second, A, B, (a), and (b) may be used to describe the elements in exemplary embodiments of the present disclosure. These terms are only used to distinguish one element from another element, and the intrinsic features, sequence or order, and the like of the corresponding elements are not limited by the terms. Unless otherwise defined, all terms used herein, including technical or scientific terms, have the same meanings as those generally understood by those with ordinary knowledge in the field of art to which the present disclosure belongs. Such terms as those defined in a generally used dictionary are to be interpreted as having meanings equal to the contextual meanings in the relevant field of art, and are not to be interpreted as having ideal or excessively formal meanings unless clearly defined as having such in the present application.

An electric compressor system 10 for a vehicle according to exemplary embodiments of the present disclosure may include an electric motor 11, an external rotation shaft 12 connected to the electric motor 11, and a first compressor unit 21 and a second compressor unit 22 sequentially arranged on the external rotation shaft 12.

The electric motor 11 may include a stator 52 fixed to a motor housing 51, a rotor 53 rotating with respect to the stator 52, and a motor shaft 54 coupled to the rotor 53. The motor housing 51 may have a first electrode 55 and a second electrode 56 electrically connected to a motor control circuit 13.

The motor housing 51 may have a first surface 51*a* and a second surface 51*b* opposing the first surface 51*a*. The first surface 51*a* may adjoin the first compressor unit 21, and the second surface 51*b* may be exposed to the outside of the electric compressor system 10.

According to exemplary embodiments of the present disclosure, the electric motor 11 may be a bidirectional motor in which the rotor 53 and the motor shaft 54 selectively rotate in any one of a first rotation direction R1 and a second rotation direction R2. Specifically, the electric motor 11 may rotate the motor shaft 54 in the first rotation direction R1 and the second rotation direction R2. For example, the first rotation direction R1 may be a counterclockwise direction, and the second rotation direction R2 may be a clockwise direction.

Figure 4:
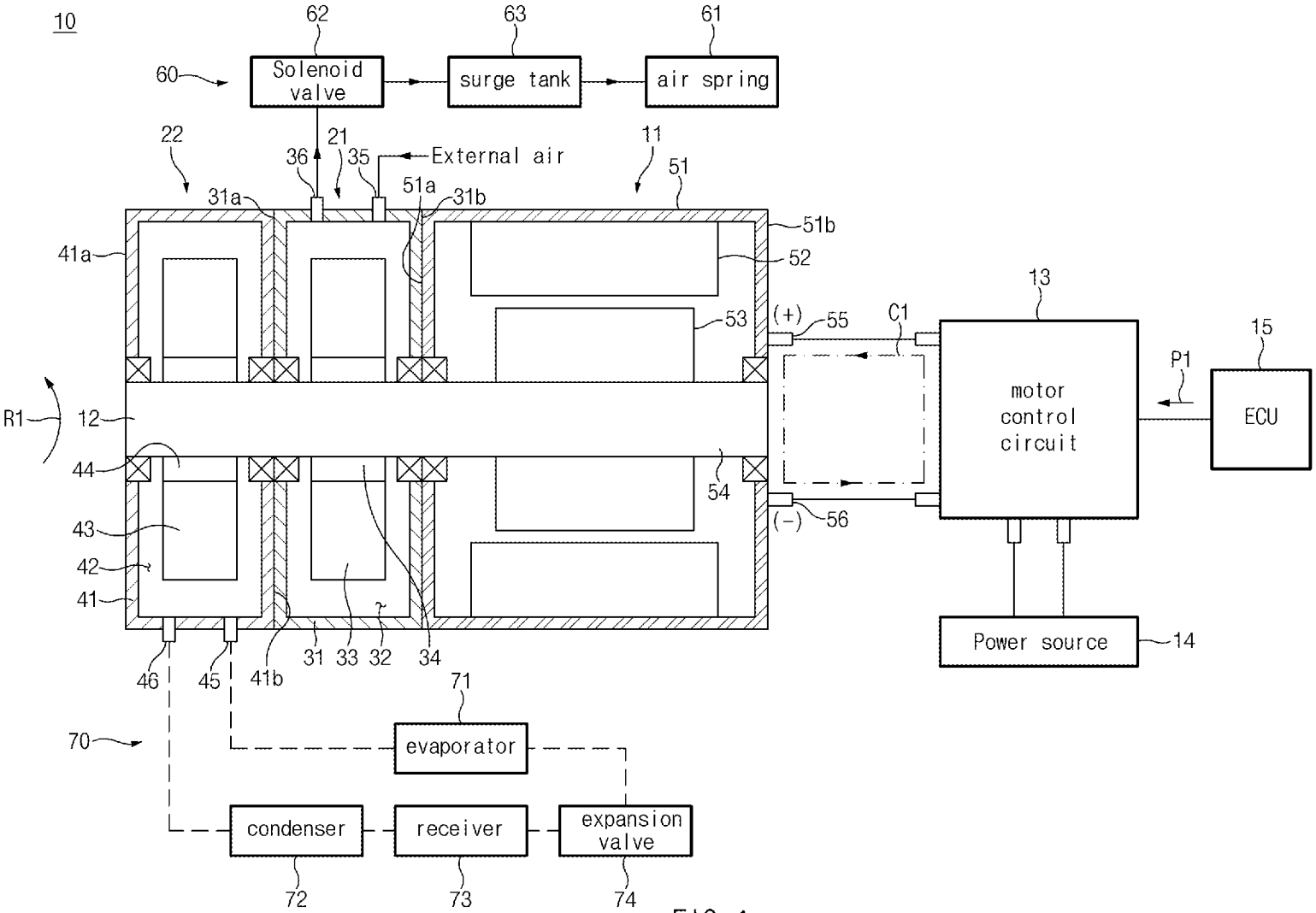
FIG. 4 illustrates an electric compressor system for a vehicle according to an exemplary embodiment of the present disclosure, allowing an electric motor to drive in a first rotation direction.
Figure 5:
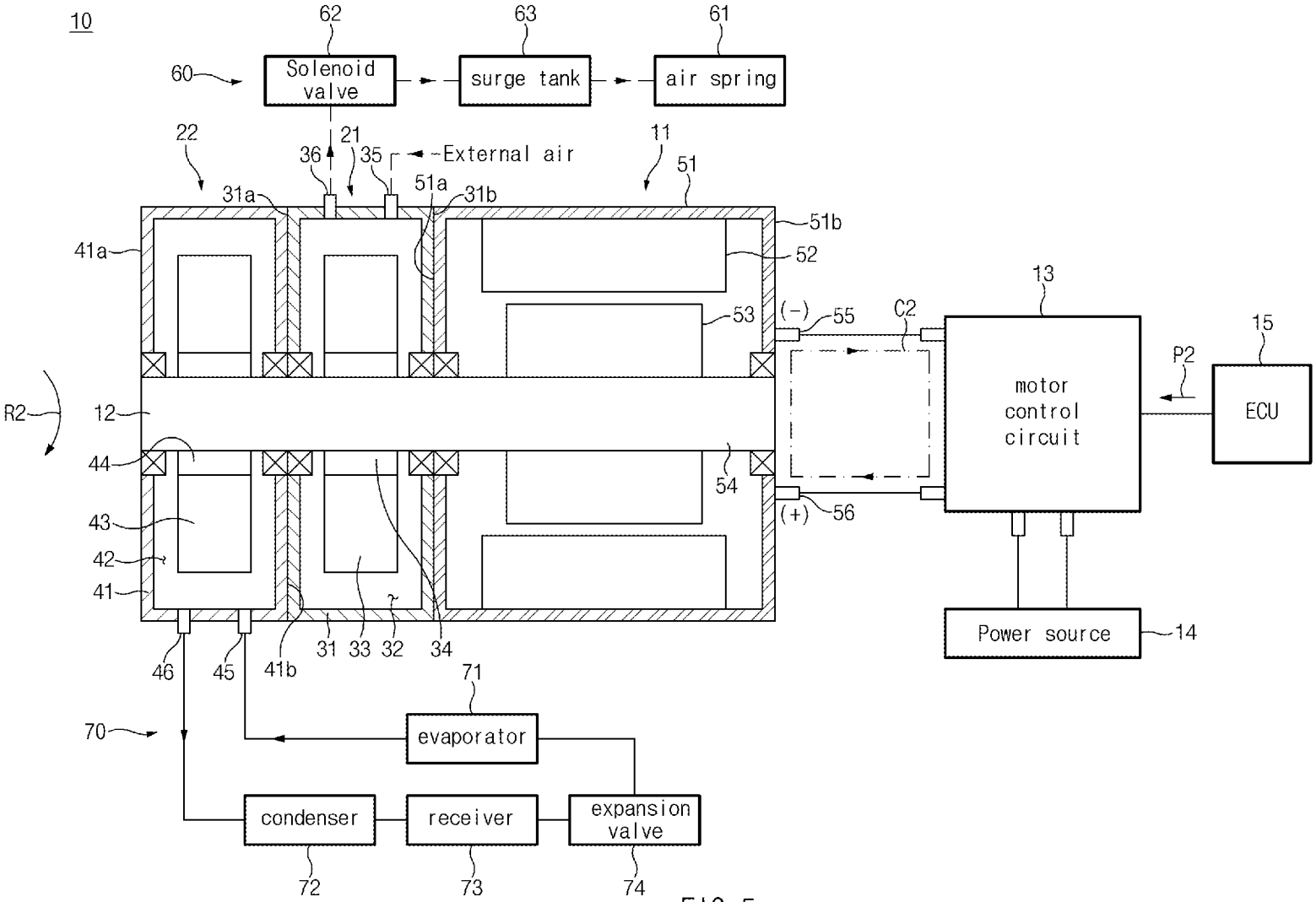
FIG. 5 illustrates an electric compressor system for a vehicle according to an exemplary embodiment of the present disclosure, allowing an electric motor to drive in a second rotation direction.

The external rotation shaft 12 may extend outwards from the motor shaft 54 of the electric motor 11. For example, as illustrated in FIGS. 1, 4, and 5, the external rotation shaft 12 may be integrally connected to the motor shaft 54 of the electric motor 11 along an axis of the motor shaft 54, and the external rotation shaft 12 and the motor shaft 54 may form a unitary one-piece structure. As another example, the external rotation shaft 12 may be coupled to an end of the motor shaft 54 of the electric motor 11 through a coupler and/or the like. Thus, the external rotation shaft 12 may rotate with the motor shaft 54 of the electric motor 11 in the same direction.

The electric motor 11 may be driven by a controller 15 such as an electronic control unit or engine control unit (ECU) and a motor control circuit 13, and the motor control circuit 13 may be electrically connected to the electric motor 11. The motor control circuit 13 may change a polarity of a voltage applied to the electric motor 11 by a power source 14 such as a battery. The controller 15 may transmit a first polarity change signal P1 or a second polarity change signal P2 to the motor control circuit 13, and the motor control circuit 13 may change the polarity of the voltage applied to the electric motor 11. The motor control circuit 13 may apply a positive voltage to the first electrode 55 or the second electrode 56 of the electric motor 11, so that a current may flow in a first direction C1 or a second direction C2.

According to one exemplary embodiment of the present disclosure, as illustrated in FIG. 4, when the controller 15 transmits the first polarity change signal P1 to the motor control circuit 13, the motor control circuit 13 may apply the positive voltage to the first electrode 55 of the electric motor 11, so that the current may flow in the first direction C1. When the current flows in the first direction C1, the rotor 53 and the motor shaft 54 of the electric motor 11 may rotate in the first rotation direction R1, and the external rotation shaft 12 may rotate with the motor shaft 54 in the first rotation direction R1.

According to another exemplary embodiment of the present disclosure, as illustrated in FIG. 5, when the controller 15 transmits the second polarity change signal P2 to the motor control circuit 13, the motor control circuit 13 may apply the positive voltage to the second electrode 56 of the electric motor 11, so that the current may flow in the second direction C2. When the current flows in the second direction C2, the rotor 53 and the motor shaft 54 of the electric motor 11 may rotate in the second rotation direction R2, and the external rotation shaft 12 may rotate with the motor shaft 54 in the second rotation direction R2.

The first compressor unit 21 may be connected to the external rotation shaft 12, and the first compressor unit 21 may selectively compress a first fluid according to the rotation direction of the external rotation shaft 12. The first compressor unit 21 may be fluidly connected to a first fluid system 60 utilizing the first fluid, and the first compressor unit 21 may compress the first fluid.

The first compressor unit 21 may include a first housing 31 having a first compression cavity 32, and a first compression element 33 compressing the first fluid received in the first compression cavity 32.

The first housing 31 may have a first surface 31*a* and a second surface 31*b* opposing the first surface 31*a*. The first surface 31*a* of the first housing 31 may adjoin the second compressor unit 22, and the second surface 31*b* of the first housing 31 may adjoin the first surface 51*a* of the motor housing 51.

The first housing 31 may have a first inlet 35 and a first outlet 36 communicating with the first compression cavity 32. The first inlet 35 may allow the first fluid to flow in, and the first outlet 36 may allow the compressed first fluid to flow out.

The first compression element 33 may be connected to the external rotation shaft 12. As the external rotation shaft rotates in the first rotation direction, the first compression element 33 may compress the first fluid in the first compression cavity 32.

The first compression element 33 may be selectively connected to or disconnected from the external rotation shaft through a first one-way clutch 34. That is, the first compression element 33 may be selectively connected to or disconnected from the external rotation shaft 12 through the engagement or disengagement of the first one-way clutch 34.

The first one-way clutch 34 may be interposed between the external rotation shaft 12 and the first compression element 33. As the first one-way clutch 34 is engaged or disengaged according to the rotation direction of the external rotation shaft 12, the first one-way clutch 34 may allow the external rotation shaft 12 and the first compression element 33 to be connected or disconnected.

According to exemplary embodiments of the present disclosure, as the external rotation shaft 12 rotates in the first rotation direction R1, the first one-way clutch 34 may be engaged so that the first one-way clutch 34 may allow the external rotation shaft 12 and the first compression element 33 to be connected. As the external rotation shaft 12 rotates in the second rotation direction R2, the first one-way clutch 34 may be disengaged so that the first one-way clutch 34 may allow the external rotation shaft 12 and the first compression element 33 to be disconnected.

Referring to FIG. 4, as the external rotation shaft 12 rotates in the first rotation direction R1, the first one-way clutch 34 may be engaged so that the first compression element 33 may be connected to the external rotation shaft 12 through the first one-way clutch 34, and accordingly the first compression element 33 may rotate with the external rotation shaft 12 in the same direction. This may allow power of the electric motor 11 to be transmitted from the external rotation shaft 12 to the first compression element 33, and the first compression element 33 may compress the first fluid in the first compression cavity 32. As the external rotation shaft 12 rotates in the second rotation direction R2 opposite to the first rotation direction R1, the first one-way clutch 34 may be disengaged so that the first compression element 33 may not be connected to the external rotation shaft 12, which means that while the external rotation shaft 12 rotates, the first compression element 33 does not rotate. Since the power of the electric motor 11 is not transmitted from the external rotation shaft 12 to the first compression element 33, the first compression element 33 may not compress the first fluid in the first compression cavity 32. When the first fluid is compressed by driving the first compressor unit 21 as the external rotation shaft 12 rotates in the first rotation direction R1, the compressed first fluid may circulate in the first fluid system 60 to allow the first fluid system 60 to operate. Here, since the second compressor unit 22 is not driven, a second fluid system 70 may not operate.

Figure 2:
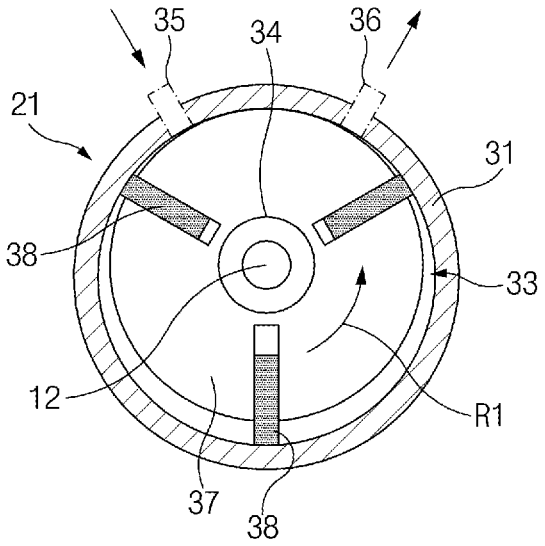
FIG. 2 illustrates a cross-sectional view taken along line A-A of FIG. 1.

The first compressor unit 21 may be a rotary compressor such as a scroll compressor, a lobe compressor, a rotary vane compressor, or a rotary screw compressor. Alternatively, various compressor structures may be applied thereto. The first compression element 33 may include various rotors such as scrolls, lobes, rotary vanes, or rotary screws. For example, as illustrated in FIG. 2, the first compressor unit 21 may be a rotary vane compressor structure, and the first compression element 33 may include a rotor 37 having a plurality of vanes 38.

The second compressor unit 22 may be connected to the external rotation shaft 12. In particular, the first compressor unit 21 and the second compressor unit 22 may be sequentially arranged on the external rotation shaft 12. The second compressor unit 22 may selectively compress a second fluid according to the rotation direction of the external rotation shaft 12. The second compressor unit 22 may be fluidly connected to the second fluid system 70 utilizing the second fluid, and the second compressor unit 22 may compress the second fluid.

The second compressor unit 22 may include a second housing 41 having a second compression cavity 42, and a second compression element 43 compressing the second fluid received in the second compression cavity 42.

The second housing 41 may have a first surface 41*a* and a second surface 41*b* opposing the first surface 41*a*. The first surface 41*a* of the second housing 41 may be exposed to the outside of the electric compressor system 10, and the second surface 41*b* may adjoin the first surface 31*a* of the first housing 31.

The second housing 41 may have a second inlet 45 and a second outlet 46 communicating with the second compression cavity 42. The second inlet 45 may allow the second fluid to flow in, and the second outlet 46 may allow the compressed second fluid to flow out.

The second compression element 43 may be connected to the external rotation shaft 12. As the external rotation shaft rotates in the second rotation direction, the second compression element 43 may compress the second fluid in the second compression cavity 42.

The second compression element 43 may be selectively connected to or disconnected from the external rotation shaft 12 through a second one-way clutch 44. That is, the second compression element 43 may be selectively connected to or disconnected from the external rotation shaft 12 through the engagement or disengagement of the second one-way clutch 44.

The second one-way clutch 44 may be interposed between the external rotation shaft 12 and the second compression element 43. As the second one-way clutch 44 is engaged or disengaged according to the rotation direction of the external rotation shaft 12, the second one-way clutch 44 may allow the external rotation shaft 12 and the second compression element 43 to be connected or disconnected.

According to exemplary embodiments of the present disclosure, as the external rotation shaft 12 rotates in the second rotation direction R2, the second one-way clutch 44 may be engaged so that the second one-way clutch 44 may allow the external rotation shaft 12 and the second compression element 43 to be connected. As the external rotation shaft 12 rotates in the first rotation direction R1, the second one-way clutch 44 may be disengaged so that the second one-way clutch 44 may allow the external rotation shaft 12 and the second compression element 43 to be disconnected.

Referring to FIG. 5, as the external rotation shaft 12 rotates in the second rotation direction R2, the second one-way clutch 44 may be engaged so that the second compression element 43 may be connected to the external rotation shaft 12 through the second one-way clutch 44, and accordingly the second compression element 43 may rotate with the external rotation shaft 12 in the same direction. This may allow the power of the electric motor 11 to be transmitted from the external rotation shaft 12 to the second compression element 43, and the second compression element 43 may compress the second fluid in the second compression cavity 42. As the external rotation shaft 12 rotates in the second rotation direction R2 opposite to the first rotation direction R1, the second one-way clutch 44 may be disengaged so that the second compression element 43 may not be connected to the external rotation shaft 12, which means that while the external rotation shaft 12 rotates, the second compression element 43 does not rotate. Since the power of the electric motor 11 is not transmitted from the external rotation shaft 12 to the second compression element 43, the second compression element 43 may not compress the second fluid in the second compression cavity 42.

When the second fluid is compressed by driving the second compressor unit 22 as the external rotation shaft 12 rotates in the second rotation direction R2, the compressed second fluid may circulate in the second fluid system 70 to allow the second fluid system 70 to operate. Here, since the first compressor unit 21 is not driven, the first fluid system 60 may not operate.

Figure 3:
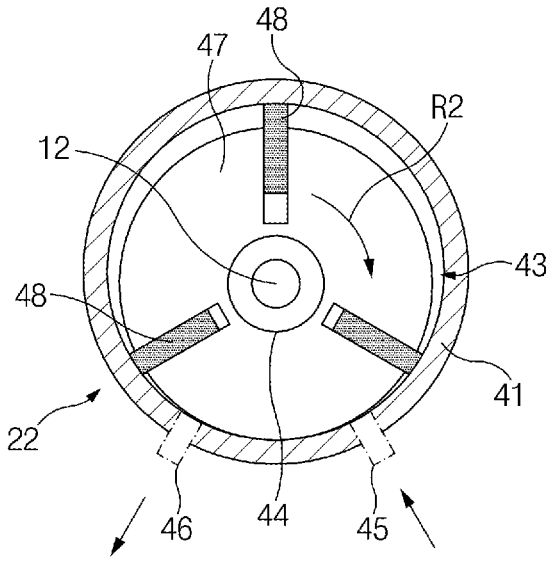
FIG. 3 illustrates a cross-sectional view taken along line B-B of FIG. 1.

The second compressor unit 22 may be a rotary compressor, such as a scroll compressor, a lobe compressor, a rotary vane compressor, or a rotary screw compressor. Alternatively, various compressor structures may be applied thereto. The second compression element 43 may include various rotors such as scrolls, lobes, rotary vanes, or rotary screws. For example, as illustrated in FIG. 3, the second compressor unit 22 may be a rotary vane compressor structure, and the second compression element 43 may include a rotor 47 having a plurality of vanes 48.

According to exemplary embodiments of the present disclosure, the motor housing 51 of the electric motor 11, the first housing 31 of the first compressor unit 21, and the second housing 41 of the second compressor unit 22 may be aligned to be attached to each other. For example, the first surface 51*a* of the motor housing 51 may be directly attached to the second surface 31*b* of the first housing 31 by welding and/or the like, and the first surface 31*a* of the first housing 31 may be directly attached to the second surface 41*b* of the second housing 41 by welding and/or the like. As the electric motor 11, the first compressor unit 21, and the second compressor unit 22 are tightly attached to each other, durability of the electric compressor system 10 may be improved.

According to exemplary embodiments of the present disclosure, the first compressor unit 21 and the second compressor unit 22 may be selectively driven by a rotational force of one external rotation shaft 12, so that a compression pressure of the first fluid by the first compressor unit 21 and a compression pressure of the second fluid by the second compressor unit 22 may be similar or the same within a predetermined range of pressure. Thus, the electric compressor system 10 according to exemplary embodiments of the present disclosure may be applied when the compression pressure of the first fluid used in the first fluid system 60 and the compression pressure of the second fluid used in the second fluid system 70 are similar to each other. For example, a compression pressure of air used in a height adjustable suspension system and a compression pressure of refrigerant used in an air conditioning system may be in a similar pressure range of about, for example, 30-40 psi.

In addition, the first compressor unit 21 and the second compressor unit 22 may be selectively driven according to the rotation direction of one external rotation shaft 12, so that the electric compressor system 10 according to exemplary embodiments of the present disclosure may be applied when the first fluid system 60 and the second fluid system 70 alternately operate. For example, the height adjustable suspension system may operate before the driving of the vehicle, and the air conditioning system may operate during the driving of the vehicle.

According to exemplary embodiments of the present disclosure, the first compressor unit 21 may be fluidly connected to the first fluid system 60 utilizing the compressed first fluid. Referring to FIGS. 1, 4, and 5, the first fluid system 60 may be, e.g., a height adjustable suspension system which adjusts a ride height, the first fluid may be the air, and the first compressor unit 21 may act as an air compressor of the height adjustable suspension system 60. The height adjustable suspension system 60 may include at least one air spring 61 fluidly connected to the first outlet 36 of the first compressor unit 21, a solenoid valve 62 disposed between the first compressor unit 21 and the air spring 61, and a surge tank 63 disposed between the solenoid valve 62 and the air spring 61. When the air, which may be, e.g., the first fluid, is supplied to the first inlet 35 of the first compressor unit 21, the air may be compressed by the first compressor unit 21. The compressed air may be supplied to the air spring 61 through the solenoid valve 62 and the surge tank 63. As the compressed air is supplied to or released from the air spring 61, the ride height may be adjusted. The height adjustable suspension system 60 may adjust the ride height as the air is supplied to or released from the air spring 61 when the vehicle is stopped or parked before driving. In addition, the first fluid system 60 may be a tire pressure control system.

According to exemplary embodiments of the present disclosure, the second compressor unit 22 may be fluidly connected to the second fluid system 70 utilizing the second fluid. Referring to FIGS. 1, 4, and 5, the second fluid system 70 may be, e.g., an air conditioning system which heats and cools the air in a passenger compartment of the vehicle, the second fluid may be the refrigerant, and the second compressor unit 22 may act as a refrigerant compressor of the air conditioning system 70. The air conditioning system 70 may include an evaporator 71 connected to the second inlet 45 of the second compressor unit 22, a condenser 72 connected to the second outlet 46 of the second compressor unit 22, a receiver located on the downstream of the condenser 72, and an expansion valve 74 disposed between the receiver 73 and the evaporator 71. When the refrigerant, which is the second fluid, is supplied to the second inlet 45 of the second compressor unit 22, the refrigerant may be compressed by the second compressor unit 22. The compressed refrigerant may be circulated through the air conditioning system 70.

The air conditioning system 70 may cool the passenger compartment of the vehicle while the vehicle is driving.

According to the above-described exemplary embodiments, the first compressor unit 21 may act as the air compressor of the height adjustable suspension system 60, and the second compressor unit 22 may act as the refrigerant compressor of the air conditioning system 70. As the first compressor unit 21 and the second compressor unit 22 are driven by one electric motor 11, the air compressor and the refrigerant compressor may form a single module.

According to the related art, an air compressor of a height adjustable suspension system has an electric motor to drive a compression mechanism for air compression, and a refrigerant compressor of an air conditioning system has an electric motor to drive a compression mechanism for refrigerant compression. That is, the air compressor and the refrigerant compressor have their own electric motors in order to drive the compression mechanisms, respectively. As the air compressor and the refrigerant compressor are individually mounted in an engine compartment, the air compressor and the refrigerant compressor may take up a relatively large space within the engine compartment, resulting in relatively low space utilization in the engine compartment.

On the other hand, as the electric compressor system 10 according to exemplary embodiments of the present disclosure has one electric motor 11, the electric compressor system 10 may take up a relatively small space in the engine compartment, thereby improving the space utilization in the engine compartment compared to the related art. In particular, as two compressors are integrated into one module, the weight and cost may be reduced.

The electric compressor system 10 having the above-described configuration according to exemplary embodiments of the present disclosure may allow one electric motor 11 to selectively drive the first compressor unit 21 and the second compressor unit 22, thereby combining two compressors into one module, which may lead to a significant reduction in volume and cost.

In addition, assemblability and maintainability of the electric compressor system 10 according to exemplary embodiments of the present disclosure may be improved as the number of components is reduced compared to the related art.

The electric compressor system 10 according to exemplary embodiments of the present disclosure may allow the first compressor unit 21 and the second compressor unit 22 to be selectively operated by the first one-way clutch 34 and the second one-way clutch 44 according to the rotation direction of one external rotation shaft 12, thereby securing the durability of the first compressor unit 21 and the second compressor unit 22.

The electric compressor system 10 according to exemplary embodiments of the present disclosure may be advantageously applied to vehicles essentially requiring the height adjustable suspension system, such as electric vehicles and high occupancy vehicles.

As set forth above, the electric compressor system according to exemplary embodiments of the present disclosure may be configured to selectively operate two or more compressor units individually connected to two or more fluid systems by a single electric motor, thereby integrating compressors of the two or more fluid systems into a single module. For example, an air compressor of a height adjustable suspension system and a refrigerant compressor of an air conditioning system may be integrated into a single module.

Hereinabove, although the present disclosure has been described with reference to exemplary embodiments and the accompanying drawings, the present disclosure is not limited thereto, but may be variously modified and altered by those skilled in the art to which the present disclosure pertains without departing from the spirit and scope of the present disclosure claimed in the following claims.

What is claimed is:

1. An electric compressor system for a vehicle, the electric compressor system comprising:

an electric motor having a rotor and a motor shaft which selectively rotate in a first rotation direction or a second rotation direction;

an external rotation shaft extending from the motor shaft of the electric motor;

a first compressor unit connected to the external rotation shaft and configured to selectively compress a first fluid according to the rotation direction of the external rotation shaft; and a second compressor unit connected to the external rotation shaft and configured to selectively compress a second fluid according to the rotation direction of the external rotation shaft, wherein the first compressor unit and the second compressor unit are sequentially arranged on the external rotation shaft, the first compressor unit is fluidly connected to a first fluid system, the second compressor unit is fluidly connected to a second fluid system, the first compressor unit includes a first housing having a first compression cavity, and a first compression element compressing the first fluid received in the first compression cavity, and the first compression element is selectively connected to or disconnected from the external rotation shaft through a first one-way clutch.

2. The electric compressor system according to claim 1, wherein the electric motor is driven by a motor control circuit, and the motor control circuit changes a polarity of a voltage applied to the electric motor.

3. The electric compressor system according to claim 2, wherein the external rotation shaft rotates in the first rotation direction when the motor control circuit applies a positive voltage to a first electrode of the electric motor.

4. The electric compressor system according to claim 2, wherein the external rotation shaft rotates in the second rotation direction when the motor control circuit applies a positive voltage to a second electrode of the electric motor.

5. The electric compressor system according to claim 1, wherein the first one-way clutch is interposed between the external rotation shaft and the first compression element, and the first one-way clutch allows the external rotation shaft and the first compression element to be connected when the external rotation shaft rotates in the first rotation direction.

6. The electric compressor system according to claim 1, wherein the second compressor unit includes a second housing having a second compression cavity, and a second compression element compressing the second fluid received in the second compression cavity, and the second compression element is selectively connected to or disconnected from the external rotation shaft through a second one-way clutch.

7. The electric compressor system according to claim 6, wherein the second one-way clutch is interposed between the external rotation shaft and the second compression element, and the second one-way clutch allows the external rotation shaft and the second compression element to be connected when the external rotation shaft rotates in the second rotation direction.

8. The electric compressor system according to claim 1, wherein the first fluid system is a height adjustable suspension system.

9. The electric compressor system according to claim 1, wherein the second fluid system is an air conditioning system.

* * * * *